US006877692B2

(12) United States Patent
Liu

(10) Patent No.: US 6,877,692 B2
(45) Date of Patent: Apr. 12, 2005

(54) OSCILLATING FOIL PROPULSION SYSTEM

(75) Inventor: Pengfei Liu, St. John's (CA)

(73) Assignee: National Research Council of Canada, Ottawa (CA)

( * ) Notice: Subject to any disclaimer, the term of this patent is extended or adjusted under 35 U.S.C. 154(b) by 0 days.

(21) Appl. No.: 10/792,692

(22) Filed: Mar. 5, 2004

(65) Prior Publication Data

US 2004/0195440 A1 Oct. 7, 2004

Related U.S. Application Data

(60) Provisional application No. 60/451,667, filed on Mar. 5, 2003.

(51) Int. Cl.[7] ..... B64C 33/00

(52) U.S. Cl. ..... 244/22; 244/72; 416/83; 440/13

(58) Field of Search ..... 244/11, 22, 72; 440/13, 14, 15, 1; 416/79, 81, 83

(56) References Cited

U.S. PATENT DOCUMENTS

| | | | | |
|---|---|---|---|---|
| 4,490,119 A | * | 12/1984 | Young | 440/114 |
| 4,688,994 A | * | 8/1987 | Gongwer | 416/82 |
| 5,401,196 A | * | 3/1995 | Triantafyllou et al. | 440/13 |
| 6,179,683 B1 | | 1/2001 | Pell et al. | |
| 6,250,585 B1 | * | 6/2001 | Pell | 244/22 |
| 6,378,801 B1 | | 4/2002 | Pell et al. | |
| 6,746,287 B2 | * | 6/2004 | Yamamoto et al. | 440/15 |

OTHER PUBLICATIONS

John Coxon , "The Development of a Self Pitching Propeller System," Woodcoxon Engineering International Ltd.

* cited by examiner

*Primary Examiner*—J. Woodrow Eldred

(74) *Attorney, Agent, or Firm*—Jones, Tullar & Cooper, PC

(57) ABSTRACT

The invention provides a propulsion system based on "thuniform" movement of a foil member to achieve desired directional movement of a vehicle such as an unmanned submarine type of vessel. A pair of foil members are mounted to the vehicle body for reciprocating oscillating movement towards and away from each other, creating forward movement due to the compression of a fluid medium between the foil members and the expulsion of the compressed fluid rearwardly of the foil members. Each foil member is mounted to a pivot shaft for limited rotational movement with respect to the vehicle body. Damping means are connected between each pivot shaft and its associated foil member so that during operation of the propulsion system damping torque will offset hydrodynamic loads imposed on the foil members by the fluid medium. The damping means will in turn control the pitch angle of the foil members during operation, meaning that a thrust is generated for rigid foil members when moving at zero forward speed. The propulsion system of the invention exhibits increased efficiency and thrust in comparison to other such propulsion systems. The foil members are mounted to the vehicle body in such a manner that the thrust vector thereof can be directed through a full 360 degrees relative to the vehicle, thereby achieving superb maneuverability when the vehicle is provided with sets of the thrusters suitable located thereon.

18 Claims, 2 Drawing Sheets

OSCILLATING FOIL PROPULSION SYSTEM

CROSS REFERENCE TO RELATED APPLICATIONS

This application claims the benefit of Provisional Patent Application No. 60/451,667 filed Mar. 5, 2003.

TECHNICAL FIELD OF THE INVENTION

This invention relates to propulsion system based on the principle of thuniform motion and is particularly applicable to underwater, and aerial, movement of vehicles. The invention improves on the efficiency and thrust capabilities of prior systems.

BACKGROUND OF THE INVENTION

This invention addresses a problem that has remained unsolved since the first consideration of the concept in the 1960s.

John Coxon and Andrew Claughton disclosed the development of an auto-pitch propeller in the publication "The Development of a Self Pitching Propeller System", (RINA), but the auto-pitch propeller uses the self-pitching technique without any damping torque. This means that each auto-pitch propeller blade rotates about its individual pivot axis freely (only with friction torque that is nearly zero). In operation, the suction side and pressure side of the auto-pitch propeller blades do not alternate.

Oscillating or flapping foil propulsors were inspired by the nature of marine swimmers. Two propulsion modes are mainly applied: the undulation mode and the thuniform mode. The undulation mode is seen in the propulsion of eels (low frequency and large amplitude for low speed swimmers). The thuniform mode is widely used by fast swimmers such as shark, dolphin, tuna and whale. An application example for the undulation mode is the Nektor™ thrust unit for unmanned underwater vehicles in which a flexible oscillating foil member rotates counterclockwise and clockwise, alternatively, about its pivoting axis to generate thrust. This mechanism is disclosed in U.S. Pat. No. 6,250,585 of Jun. 26, 2001.

In the Nektor™ unit the foil and the rotational shaft do not have relative rotation. The shaft rotates in counterclockwise and clockwise directions alternatively to create thrust. This propulsor uses the undulation mode (eel's propulsion mode) so it does not produce thrust if the foil is rigid.

A rigid oscillating foil member with a zero damping torque, about its pivot axis will produce nearly zero thrust. In the traditional oscillating foil configuration, the damping torque is infinity, i.e., the pivot shaft and the foil are the same piece. When a traditional rigid oscillating foil (infinite damping torque) has only heave motion, it produces nearly zero thrust at low advance speed. Enabling both pitch and heave motion for an oscillating foil requires a complicated control mechanism, which is too complicated and of low efficiency to be used in practical application. This invention provides a heave only oscillation foil with a regulated thrust at all speeds. At standstill, the start-up speed of a marine vehicle is important; a zero thrust at start up means that a vehicle will never start to move).

Regardless of the mode of oscillating foil propulsors, all previous oscillating foils have no relative angular displacement between the foil's pivot axis and the rotational shaft, i.e., there is no slip rotation. Pitch of the oscillating foil member is either controlled by a pitch mechanism, such as a flexible bar that is linked to the foil or there is no pitching at all (pure heave motion with a constant pitch angle). To increase the efficiency of propulsion, there have been some foil members and spans made with flexibility in the foil itself.

SUMMARY OF THE INVENTION

There are two key technologies associated with the present invention. (a) The propulsion system of the invention creates thrust for rigid foils at zero forward velocity while existing foil propulsion systems cannot. (b) The design of the mechanism for mounting the propulsion system to a vehicle permits the thruster unit to rotate about its axis such that the thrust vector thereof can be directed at any desired orientation through 360°.

With an oscillating foil or wing, both pitch and heave motions of the foil member need to be controlled, periodically and precisely, to produce the maximum possible efficiency and thrust. For pitch control, this requires power to drive the motion and a regulation mechanism to vary the magnitude and direction. Some oscillating foil propulsors use a simple heave-only motion to save energy and avoid a complicated pitch control mechanism. Using a flexible foil or flexible bar-foil configuration for this simple heave-only motion can slightly reduce the problem by increasing the thrust with some sacrifice in efficiency.

This invention provides a novel technique applicable to oscillating foils or wings to produce both high efficiency and thrust. This essence of the technique is to permit rotational motion between the foil member and the pivot shaft that supports the foil member and to provide a damping torque, which can either be controllable or constant, depending on the application, to offset dynamic torque affecting the foil during operation. The instantaneous hydrodynamic angle of attack of the foil member is controlled by both the damping torque and the dynamic force on the foil.

This invention relates to a new and unique technique for an oscillating foil to produce regulated thrust under a hydrodynamically self-adjusted pitching angle that is controlled by damping torque applied about the foil's pitch or pivot axis. Distinguished from all the existing oscillating foil propulsors, the foil member rotates about the pivot shaft. The pivot shaft has only vertical motion (i.e. motion normal to the direction of desired movement), which is the heave motion that may be converted from rotational motion to translational motion, under a constant motor or engine speed. The foil member can be either flexible or rigid. This relative rotational motion of the foil member about its pivot axis can be achieved either by relative rotation between the pivot shaft and the foil member or by relative rotation between the pivot shaft and the thruster unit itself. In the latter case there would be no relative motion between the pivot shaft and the foil member. By controlling the damping torque about the pivot shaft either electronically or mechanically or both, thrust production can be regulated at a constant oscillating frequency and heave amplitude. Depending on the range of precision of the pitch control the damping torque may be controlled mechanically. The mechanism may either consume little power or no power at all. A simple passive mechanism control can be achieved, for example, by only a piece of rubber or spring that is attached on the pivot shaft internal of the foil member (permitting relative motion between the foil member and the pivot shaft) or external of the foil member (if there is no relative motion between the foil member and the pivot shaft). A more precisely regulated damping control requires an actuation mechanism and an encoder.

The present invention operates as well on the principle of "wing-in-ground-effect" (WIG effect), created by the oscillatory movement of the two foil members in counter phase. In aviation parlance, the WIG effect is created when an aerofoil (wing) approaches the ground. It then experiences an increase in lift and a corresponding reduction in the lift/drag ratio. A cushion of air is created between the wing and the ground. In the present invention the foil members create a "cushion" of air therebetween as they approach each other during an operating cycle, thus the "WIG effect", and thrust is created as the compressed air is expelled from the zone between the foil members. The thrust and efficiency created by the pair of oscillating foil members is considerably improved over that created by a single foil member as utilized in known systems.

In its broadest form the present invention may therefore be considered to provide a propulsion system which utilizes a pair of elongated spaced apart foil members. Means are provided for mounting the foil members to a body to be driven through a fluid medium, the mounting means being located at the center of gravity of each such foil member and defining a pivot axis for each foil member, with each foil member being attached to its respective mounting means for limited rotational movement with respect to the body on the pitch axis. Means are connected to the mounting means for driving the mounting means in an oscillatory manner such that during such driving the foil members move towards and away from each other at the same rate. Means are also provided for damping the rotational movement of each foil member relative to its respective mounting means during the oscillatory movement of the foil members. The damping means generate damping forces or torque that offset dynamic forces or torque imposed on the foil members by the fluid medium during operation of the propulsion system. By controlling the degree of damping provided to the foil members it is in turn possible to control the pitch or angle of attack of each foil member during its oscillatory movement.

The invention will now be described with reference to the drawings.

DESCRIPTION OF THE PREFERRED EMBODIMENTS

The present invention provides a propulsion system based on the principles of thuniform movement, namely the movement of a foil member in a sideways or vertical manner to achieve forward movement of a vehicle or living body. Such movement is found in nature with fast moving fish or mammals such as tuna, sharks, dolphins and whales. Thuniform movement differs from undulating propulsion systems as used by slower moving fish such as eels. In addition the present invention is based on the principles associated with a "WIG effect" as mentioned hereinabove.

Figures 1, 5:
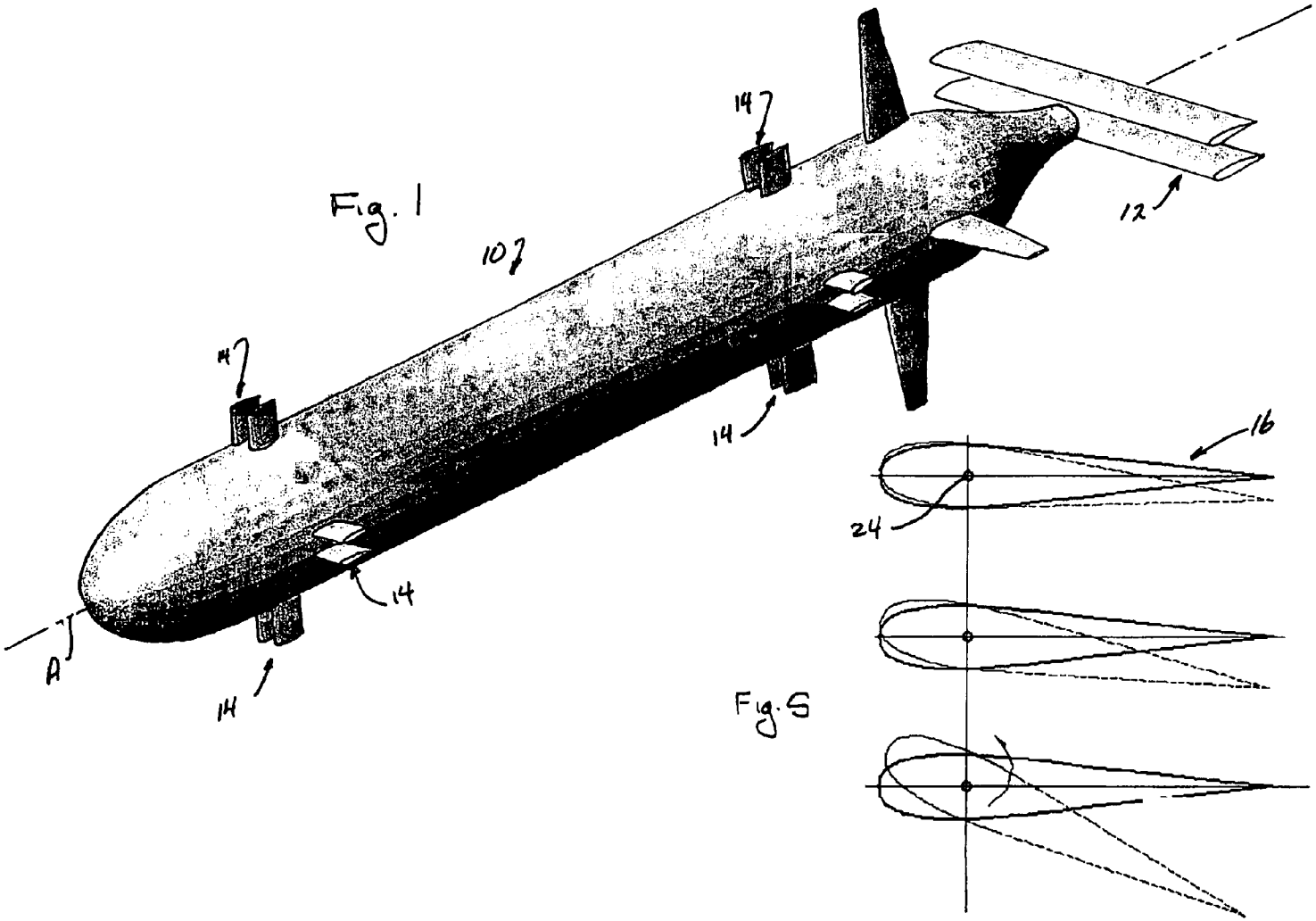
FIG. 1 shows in a schematic fashion a perspective view of a vehicle with a plurality of propulsion systems in accordance with this invention secured thereto.
FIG. 5 shows schematically the effects of damping on one of the foil members of the present propulsion system.

With reference first of all to FIG. 1 a vehicle 10 is shown therein as having a plurality of propulsion systems 12, 14 in accordance with the present invention mounted thereto. The system 12 is provided at the rear end of the vehicle and is intended to impart forward motion only to the vehicle. The systems 14 are mounted to the body of the vehicle and are intended to provide thrust at any angle about the mounting axis thereof, through a full 360°. The mounting axis will typically be normal to the longitudinal axis A of the vehicle. In the embodiment shown in FIG. 1 six propulsion systems 14 are visible, shown in two groups of three such systems spaced apart longitudinally of the vehicle. In fact, in the embodiment as illustrated, there would be a fourth system associated with each group, for a total of eight systems 14. The systems of each group would be separated from each other by 90°. Of course, depending on the particular application more or fewer such systems could be mounted to the vehicle. Since each system 14 is capable of being independently rotated about its mounting axis it is readily seen that an infinite number of thrust vectors operating on the vehicle can be created, meaning that the vehicle can move readily in any direction whatsoever, not in just a longitudinal direction.

Figure 2:
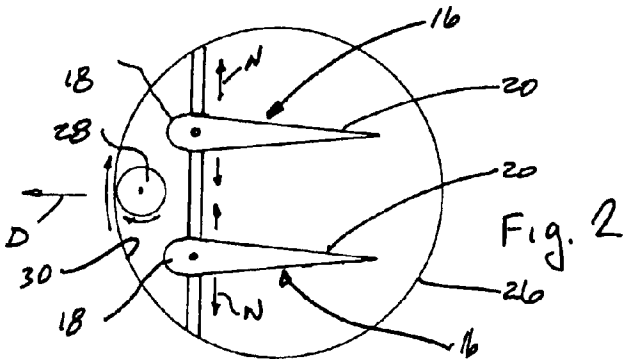
FIG. 2 shows in schematic fashion an end view of the basic features of the present propulsion system.
Figure 3:
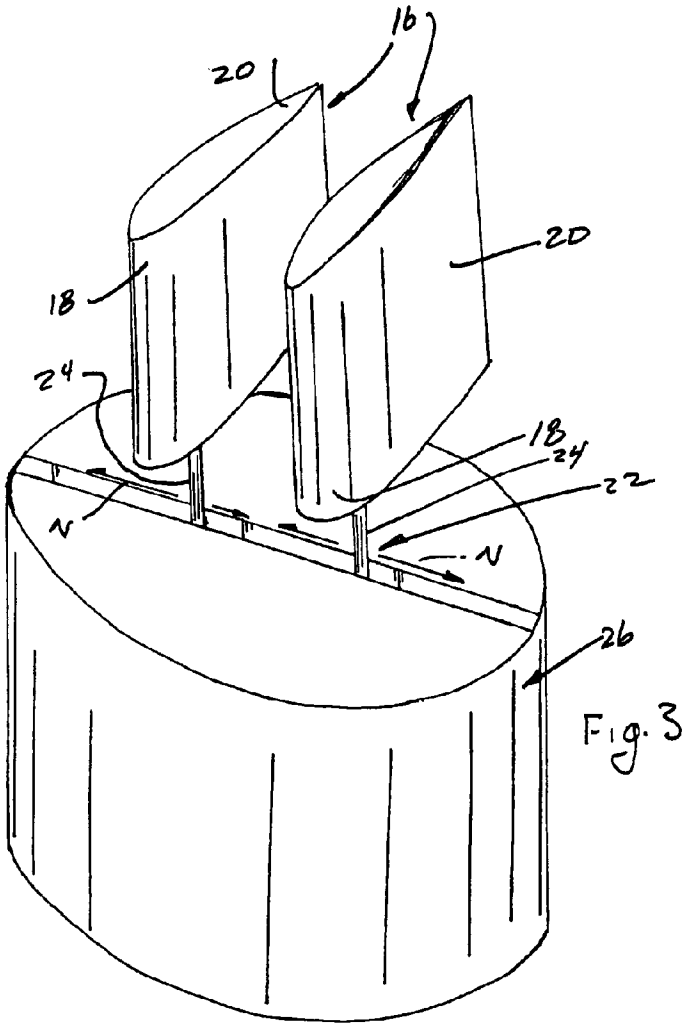
FIG. 3 shows in schematic fashion a perspective view of a the system of FIG. 2.

Turning now to FIGS. 2 and 3 it will be seen that the propulsion system of the present invention, whether a system 12 or a system 14, includes a pair of elongated spaced apart foil members 16, 16. Each foil member 16 preferably has a symmetrical aerofoil shape including a bulbous nose portion 18 which tapers rearwardly to a tail portion 20. The foil member 16 can be rigid or it can also be capable of a limited degree of flexibility. The foil member need not be as shown in these figures; it could take other forms, including a simple flat plate, while still acting as a lifting surface.

Each foil member 16 is attached to a mounting means 22 in the form of a pivot shaft 24, which in turn is connected to a drive means contained within the vehicle 10 or within a separate pod section 26, which in turn is mounted to the vehicle 10. The pivot shaft 24 extends along an axis K which is normally allocated near or generally coincides with the aerodynamic center of the foil member, although such positioning is not essential to operability. In fact, depending on the torsional elasticity of the damping means or special propulsion needs, this axis may be set far in front of or behind the aerodynamic center. This is the pivot or pitch axis for the foil member. The drive means can take the form of an electric motor (for example), not shown, which is connected to suitable means such as gears and bell cranks or other types of transmission arrangements for translating rotary motion into linear motion. Thus, when the motor is operating, the translation means will operate on each pivot shaft to move that shaft in a direction N normal to the desired direction D of movement of the vehicle. In the orientation shown in FIG. 2 the pivot shafts 24 will move vertically, with the direction of desired movement D being towards the left edge of the page. With the present invention the movement of one foil member 16 will be opposite to the movement of the other foil member, such that the movements are out of phase relative to each other. Each foil member has an oscillatory movement applied thereto by the drive means with such movements being opposite to each other whereby during an operational cycle it will be seen that the foil members will move towards and away from each other at the same rate. This has the effect of compressing the fluid medium between the foil members as they approach each other during each cycle and expelling the compressed fluid rearwardly at the same time to create the desired thrust. As the foil members move away from each other more fluid is drawn into the space between the foil members to be compressed and expelled as the system operates. The forces generated by the oscillating foil members are generated in the same manner as those generated by an aircraft wing when it is close to the ground during landing or take-off, known as "wing-in-ground effect" (WIG effect).

In the embodiment shown in FIGS. 1, 2 and 3 the drive pod section 26 is shown as being cylindrical in form. In order to achieve 360° of thrust vectoring a small diameter pinion gear 28 co-operates with a geared rack 30 on the inner surface of the pod section. As the pinion gear 28 rotates so will the pod section 26 thereby adjusting the direction of the thrust vector relative to the vehicle 10. Of course, other means of altering the thrust vector direction could be implemented, including for example having a pinion gear engaging a rack on the exterior of the pod section or having a drive gear engaging a driven gear connected to a shaft coaxial of the pod section.

Figure 4:
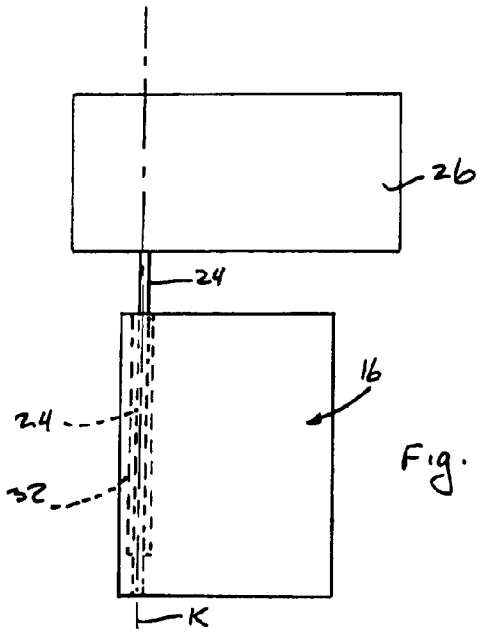
FIG. 4 shows schematically a top plan view of the configuration of FIG. 2.

With reference to FIG. 4 it will be seen that a damping member 32 surrounds the shaft 24. The damping member is connected both to the shaft 24 and to the internal structure of the foil member 16. The damping means can be any form of resilient material including, for example, rubber. The effect of the damping means is to resist the pitching movement of the foil member as it rotates on its pivot shaft 24 and in particular to offset hydrodynamic forces imposed on the foil member by the fluid medium in which the propulsion system operates. While a simple mechanical form of damping means internal to the foil member has been illustrated, it should be understood that other damping means could be provided, including electrical, magnetic and/or electromagnetic. It is also understood that the damping means could be external to the foil member. The form of the damping means is not critical to the invention; it is the actual provision of some form of damping means that is essential to the invention.

The propulsion mode of this present invention may be characterized as being "thuniform", although that is primarily a biological term that is used generally to describe the propulsion of a fish. The shaft that supports the foil moves only up and down (a heave motion). With reference to FIG. 5, one (the "upper" one) of the pair of foil members is shown at several positions during an operational cycle with a controlled damping torque applied thereto. The solid line foil member profiles illustrate the traditional oscillating foil positions in pure heave and the dashed lines illustrate the profiles for a damped control of the torque. As is seen, the damping torque applied to the mounting shaft 24, opposed to the direction of rotation, has the effect of increasing the pitch angle when the foil member 16 is at its central or equilibrium position and of decreasing the pitch angle when the foil member is at the upper limit of its oscillatory motion. If the pivot axis is located far behind the aerodynamic center then the damping torque will have the effect of decreasing the pitch angle when the foil member is at its equilibrium position and of increasing the pitch angle when the foil member is at the upper limit of its oscillatory motion. Thus, the foil member pitches about the mounting shaft at an angle that is balanced between the damping torque and the hydrodynamic loads on the foil member.

In oscillation, the foil is free to rotate about the pivot axis when the damping torque is set to zero (either regulated electronically or mechanically). Controlling the damping torque can regulate the thrust production and efficiency. That is, the motor or engine rotational speed and direction do not need to be changed to produce a regulated thrust.

From the foregoing it is clear that the present invention provides a means for improving the efficiency and the thrust production of a propulsion system using oscillating foil members. While the system of the present invention has been described with respect to a marine type of vehicle, such as an unmanned submarine or research vessel, the principles of operation can be applied to other types of vehicles, including both marine and aerial vehicles, without departing from the spirit of the invention. Accordingly, the protection to be afforded this invention is to be determined from the claims appended hereto.

What is claimed is:

1. A propulsion system comprising:

a pair of elongated spaced apart foil members;

means for mounting said foil members to a body to be driven by said foil members through a fluid medium, said mounting means defining a pivot axis for each foil member, and each said foil member being attached to its respective mounting means for limited rotational movement with respect to said body on said pivot axis;

means connected to said mounting means for driving said mounting means in a linear oscillatory manner along a common path normal to a desired thrust vector such that during such driving the foil members move towards and away from each other at the same rate; and means for damping the rotational movement of each said foil member relative to its respective mounting means during the oscillatory movement of the foil members, whereby damping torque generated by said damping means will offset dynamic torque on said foil members imposed thereon by said fluid medium during operation of said propulsion system.

2. The propulsion system of claim 1 wherein said driving means comprises motor means connected to means for converting rotary motion to linear motion, said converting means being in turn connected to said mounting means whereby said mounting means impart said oscillatory motion to said foil members.

3. The propulsion system of claim 2 wherein each said mounting means comprises an elongated shaft member on which the associated foil member is free to rotate through a limited angular range.

4. The propulsion system of claim 3 wherein said damping means is connected between the shaft member and the associated foil member.

5. The propulsion system of claim 3 wherein said motor means is contained within a pod mounted to said body and means are provided for rotating said pod, and thus said propulsion system, through 360°.

6. The propulsion system of claim 5 wherein said pod is generally cylindrical and said means for rotating includes a pinion gear mounted to said body, motor means for driving said pinion gear, and a rack gear mounted to said pod, such that rotation of said pinion gear will result in relative rotation of said pod and said propulsion system for altering the angle of the thrust vector of said propulsion system relative to a longitudinal axis of said body.

7. The propulsion system of claim 5 wherein said damping means is connected between the shaft member and the associated pod.

8. The propulsion system of claim 1 wherein each said foil member is a lifting body having a generally aerofoil shape with a bulbous forward section smoothly merging with a rearwardly tapering rear section.

9. The propulsion system of claim 1 wherein each said foil member is in the shape of a generally flat plate serving as a lifting surface.

10. The propulsion system of claim 1 wherein said damping means will increase the pitch angle of each foil member as the foil members approach each other and will decrease the pitch angle of each foil member as the foil members approach a position of maximum separation from each other.

11. The propulsion system of claim 1 wherein said damping means will decrease the pitch angle of each foil member as the foil members approach each other and will increase the pitch angle of each foil member as the foil members approach a position of maximum separation from each other.

12. A propulsion system comprising:

a pair of elongated spaced apart foil members, each said foil member having a generally aerofoil shape with a bulbous forward section smoothly merging with a rearwardly tapering rear section;

pivot shaft means for mounting said foil members to a body to be driven by said foil members through a fluid medium, said shaft means defining a pivot axis for each foil member, and each said foil member being attached to its respective pivot shaft means for limited rotational movement with respect thereto on the pivot axis thereof;

motor means connected to means for converting rotary motion to linear motion, said converting means being in turn connected to said pivot shaft means whereby the linear motion of said pivot shaft means along a common path normal to a desired thrust vector imparts oscillatory motion to said foil members such that during operation of said propulsion system the foil members move towards and away from each other at the same rate; and means connected to each pivot shaft means and the foil member associated therewith for damping the rotational movement of each said foil member relative to its respective pivot shaft means during the oscillatory movement of the foil members, whereby damping torque generated by said damping means will offset dynamic torque on said foil members imposed thereon by said fluid medium during operation of said propulsion system.

13. The propulsion system of claim 11 wherein said motor means is contained within a pod mounted to said body and means are provided for rotating said pod, and thus said propulsion system, through 360°.

14. The propulsion system of claim 13 wherein said pod is generally cylindrical and said means for rotating includes a pinion gear mounted to said body, motor means for driving said pinion gear, and a rack gear mounted to said pod, such that rotation of said pinion gear will result in relative rotation of said pod and said propulsion system for altering the angle of the thrust vector of said propulsion system relative to a longitudinal axis of said body.

15. The propulsion system of claim 14 wherein said damping means will increase the pitch angle of each foil member as the foil members approach each other and will decrease the pitch angle of each foil member as the foil members approach a position of maximum separation from each other.

16. The propulsion system of claim 12 wherein said damping means will decrease the pitch angle of each foil member as the foil members approach each other and will increase the pitch angle of each foil member as the foil members approach a position of maximum separation from each other.

17. A propulsion system comprising:

a pair of elongated spaced apart foil members;

means for mounting said foil members to a body to be driven by said foil members through a fluid medium, each said foil member being attached to its respective mounting means for limited rotational movement with respect thereto;

motor means connected to said mounting means for driving said mounting means in an oscillatory manner such that during such driving the foil members move towards and away from each other at the same rate; and means connected between each said mounting means and the foil member associated therewith for damping the rotational movement of each said foil member relative to its respective mounting means during the oscillatory movement of the foil members, whereby damping torque generated by said damping means will offset dynamic torque on said foil members imposed thereon by said fluid medium during operation of said propulsion system;

said motor means being contained within a pod mounted to said body and including means for rotating said pod, and thus said propulsion system, through 360° such that thrust created by said propulsion system can be directed along any desired vector.

18. The propulsion system of claim 17 wherein said pod is generally cylindrical and said means for rotating includes a pinion gear mounted to said body, motor means for driving said pinion gear, and a rack gear mounted to said pod, such that rotation of said pinion gear will result in relative rotation of said pod and said propulsion system for altering the angle of the thrust vector of said propulsion system relative to a longitudinal axis of said body.

* * * * *